US009673561B2

(12) United States Patent
Imai

(10) Patent No.: US 9,673,561 B2
(45) Date of Patent: Jun. 6, 2017

(54) CONNECTOR AND STRUCTURE FOR FIXING CONNECTOR TO WIRING HARNESS

(71) Applicant: Sumitomo Wiring Systems, Ltd., Yokkaichi, Mie (JP)

(72) Inventor: Yasuo Imai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/125,241

(22) PCT Filed: Mar. 11, 2015

(86) PCT No.: PCT/JP2015/057096
§ 371 (c)(1),
(2) Date: Sep. 12, 2016

(87) PCT Pub. No.: WO2015/151741
PCT Pub. Date: Oct. 8, 2015

(65) Prior Publication Data

US 2017/0098913 A1 Apr. 6, 2017

(30) Foreign Application Priority Data

Apr. 1, 2014 (JP) ..... 2014-075304

(51) Int. Cl.
*H01R 13/514* (2006.01)
*H01R 24/28* (2011.01)
(Continued)

(52) U.S. Cl.
CPC ..... *H01R 13/514* (2013.01); *H01R 13/5837* (2013.01); *H01R 24/28* (2013.01); *H01R 12/716* (2013.01)

(58) Field of Classification Search
CPC ... H01R 13/514; H01R 13/516; H01R 13/518
See application file for complete search history.

(56) References Cited

U.S. PATENT DOCUMENTS 5,727,969 A * 3/1998 Yamanashi ..... H01R 13/193 439/594
5,904,598 A * 5/1999 Yamanashi ..... H01R 12/777 439/354
(Continued)

FOREIGN PATENT DOCUMENTS

JP 8-321348 12/1996
JP 11-312547 11/1999
(Continued)

OTHER PUBLICATIONS

International Search Report, PCT 210 dated May 26, 2015.

*Primary Examiner* — James Harvey
(74) *Attorney, Agent, or Firm* — Gerald E. Hespos; Michael J. Porco; Matthew T. Hespos

(57) ABSTRACT

It is aimed to prevent a tape from being displaced in the case of taping a connector. In the case of fixing a connector to a wiring harness (WH) by winding a tape, upper-surface side ribs (9) extending in a direction substantially perpendicular to a winding direction of a tape (T) are formed to project on opposite end parts of the upper surface of a connector housing (1). In the case of taping, a winding width is set to be wider than the upper-surface side ribs (9). Since this causes opposite end parts of the upper-surface side ribs (9) in an extending direction to serve as parts for catching the tape (T), a situation where the tape (T) is displaced in the extending direction of the upper-surface side ribs (9) can be prevented.

2 Claims, 8 Drawing Sheets

(51) Int. Cl.
*H01R 13/58* (2006.01)
*H01R 12/71* (2011.01)

(56) References Cited

U.S. PATENT DOCUMENTS

| | | | | |
|---|---|---|---|---|
| 6,193,550 | B1 | 2/2001 | Yamashita et al. | |
| 6,485,327 | B1 * | 11/2002 | Morlock | H01R 25/003 439/216 |
| 6,881,100 | B2 * | 4/2005 | Barry | H01R 12/716 439/701 |
| 7,347,744 | B2 * | 3/2008 | Tabata | H01R 13/514 439/289 |
| 7,404,744 | B2 * | 7/2008 | Amano | H01R 13/514 439/540.1 |
| 7,625,250 | B2 * | 12/2009 | Blackwell | H05K 5/0021 439/717 |

FOREIGN PATENT DOCUMENTS

| | | |
|---|---|---|
| JP | 2003-249296 | 9/2003 |
| JP | 2006-134586 | 5/2006 |
| JP | 2010-067457 | 3/2010 |
| JP | 2011-159437 | 8/2011 |
| JP | 2014-102998 | 6/2014 |

* cited by examiner

CONNECTOR AND STRUCTURE FOR FIXING CONNECTOR TO WIRING HARNESS

BACKGROUND

1. Field of the Invention

The present invention relates to a connector and a structure for fixing a connector to a wiring harness.

2. Description of the Related Art

Conventionally, there are known such connectors that coupling means are formed on outer surfaces of connector housings and the connector housings are coupled to and united with each other. Japanese Unexamined Patent Publication No. H08-321348 discloses an example of such a connector. In such a connector, female coupling portions are provided on one of upper and lower surfaces and one of left and right side surfaces of the connector housing and male coupling portions are provided on the opposite surfaces. By fitting the male coupling portion into the female coupling portion for locking, the connector housings are connectable in a vertical or lateral direction.

The connector disclosed in Japanese Unexamined Patent Publication No. H08-321348 has a relatively small number of poles. Thus, a fitting structure of the male and female coupling portions extends substantially over the entire widths of the surfaces where these are formed. Thus, the facing surfaces of the connector housings in the coupled state are in contact with each other and rattling is unlikely to occur.

However, if the number of the poles of the connector increases and the connector housing is enlarged in one direction, the fitting structure of the male and female coupling portions is provided on parts of the surfaces where these are formed and the facing surfaces of the connector housings are connected with each other in a limited partial area. Thus, the coupled state may become unstable because the connector housings easily are inclined relative to each other.

The present invention was completed based on the above situation and aims to provide a connector capable of stable mutual coupling and a fixing structure capable of stably fixing a connector to a wiring harness in the case of winding a tape around the connector.

SUMMARY

The present invention relates to a connector with a connector housing that can be coupled to a plurality of connector housings. A coupling portion is provided on an outer surface of the connector housing and enables the connector housings to be coupled to each other. Holding portions project at opposite sides of the coupling portion on the outer surface of the connector housing and are capable of butting against the connector housing as a coupling partner when the connector housings are coupled. Thus, even if the connector housings are going to be inclined while being coupled to each other, the inclination of the connector housings is restricted by being supported by the holding portions. As a result, a coupled posture of the connector can be stabilized.

The holding portions may project on both facing surfaces when the connector housings are coupled and projecting heights thereof may be lower than that of the coupling portion. Thus, an effect of protecting the holding portions from damage by external matter is exhibited by the coupling portion.

The invention also relates to a structure for fixing the connector to a wiring harness. More particularly, the holding portions are ribs extending in a direction substantially perpendicular to a winding direction of a tape and project from the outer surface of the connector housing. The connector is taped to the wiring harness so that a winding width of the tape is larger than lengths of the ribs in an extending direction and extending end parts of the ribs serve as parts for catching the tape in the extending direction. Thus, the connector can be fixed reliably to the wiring harness.

Further, in the case of taping the connector to the wiring harness, the tape can be wound in close contact with the coupling portion and the holding portions without being lifted since the holding portions located at the opposite sides of the coupling portion are lower than the coupling portion

DETAILED DESCRIPTION

Next, a specific embodiment of a connector of the present invention is described with reference to the drawings.

Figure 1:
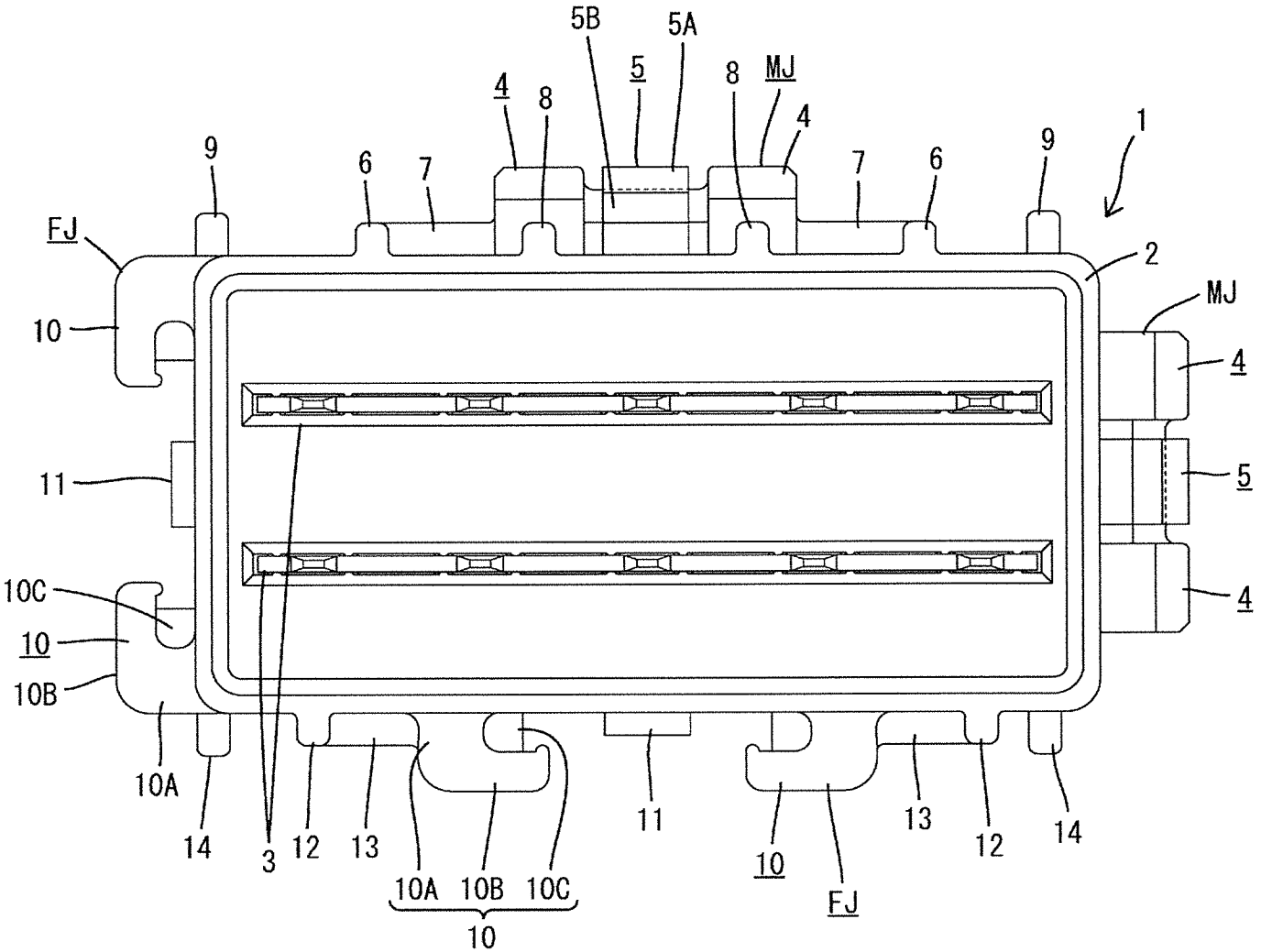
FIG. 1 is a front view of a connector.

The connector of this embodiment is a joint connector and includes a connector housing 1 made of synthetic resin. The connector housing 1 includes a receptacle 2 formed into a rectangular tube shape, and an unillustrated mating connector is fittable into the receptacle 2. As shown in FIG. 1, the receptacle 2 is formed to be laterally long by having a longer horizontal dimension than a vertical dimension, and open forward. Joint terminals 3 are mounted in two upper and lower rows in the receptacle 2. The joint terminal 3 is formed by coupling one end of each of a plurality of tab-shaped terminals, and the other ends of the tab-shaped terminals project horizontally project in parallel into the receptacle 2.

Figure 6:
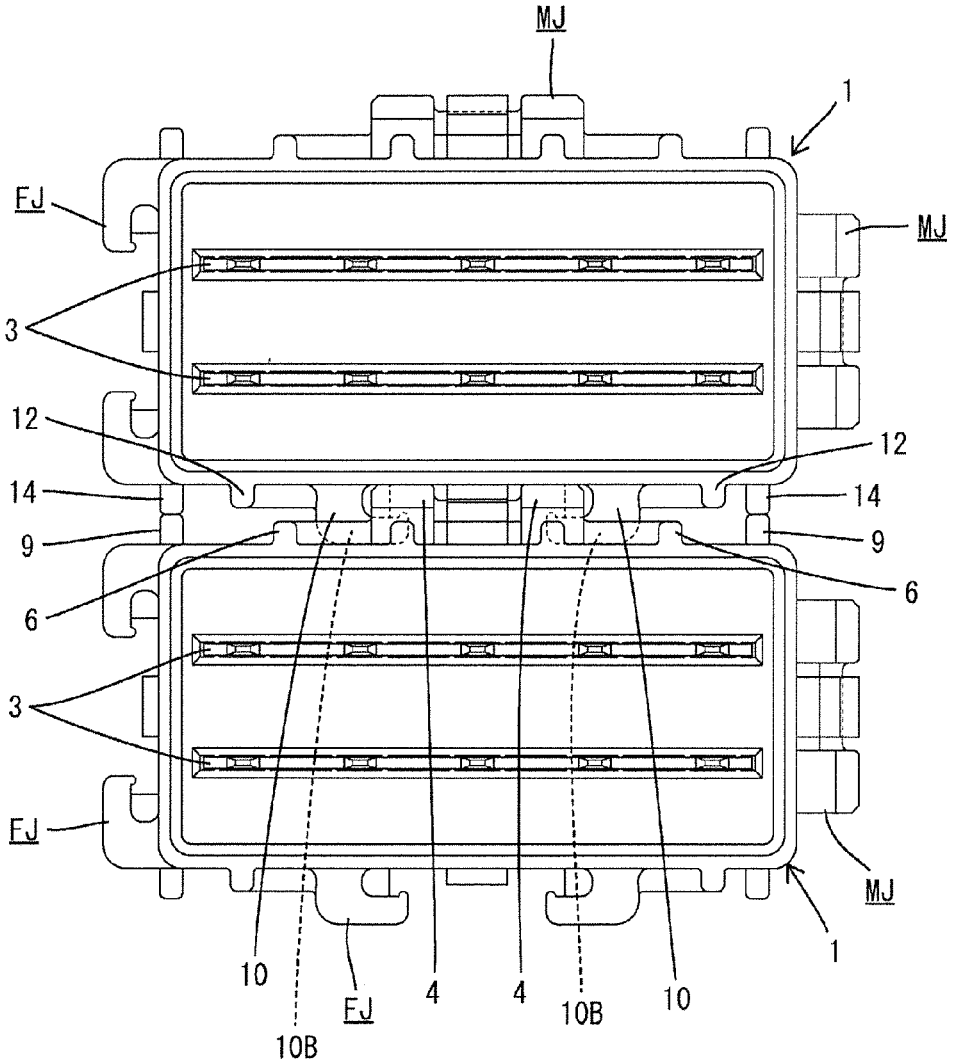
FIG. 6 is a front view showing a coupled state of the connectors.

Coupling portions FJ, MJ for coupling the connector housings 1 to each other are provided on both upper and lower surfaces and both left and right side surfaces of the connector housing 1. Out of these, the male coupling portions MJ are arranged on the upper surface (see FIG. 2) and the right side surface (see FIG. 4), and the female coupling portions FJ are arranged on the lower surface (see FIG. 3) and the left side surface. These female or male coupling portions FJ, MJ are lockable to the male or female coupling portions MJ, FJ of the connector housing 1 as a coupling partner, and the connector housings 1 can be coupled to each other as shown in FIG. 6. Next, the configuration of each surface of the connector housing 1 is described.

Figure 2:
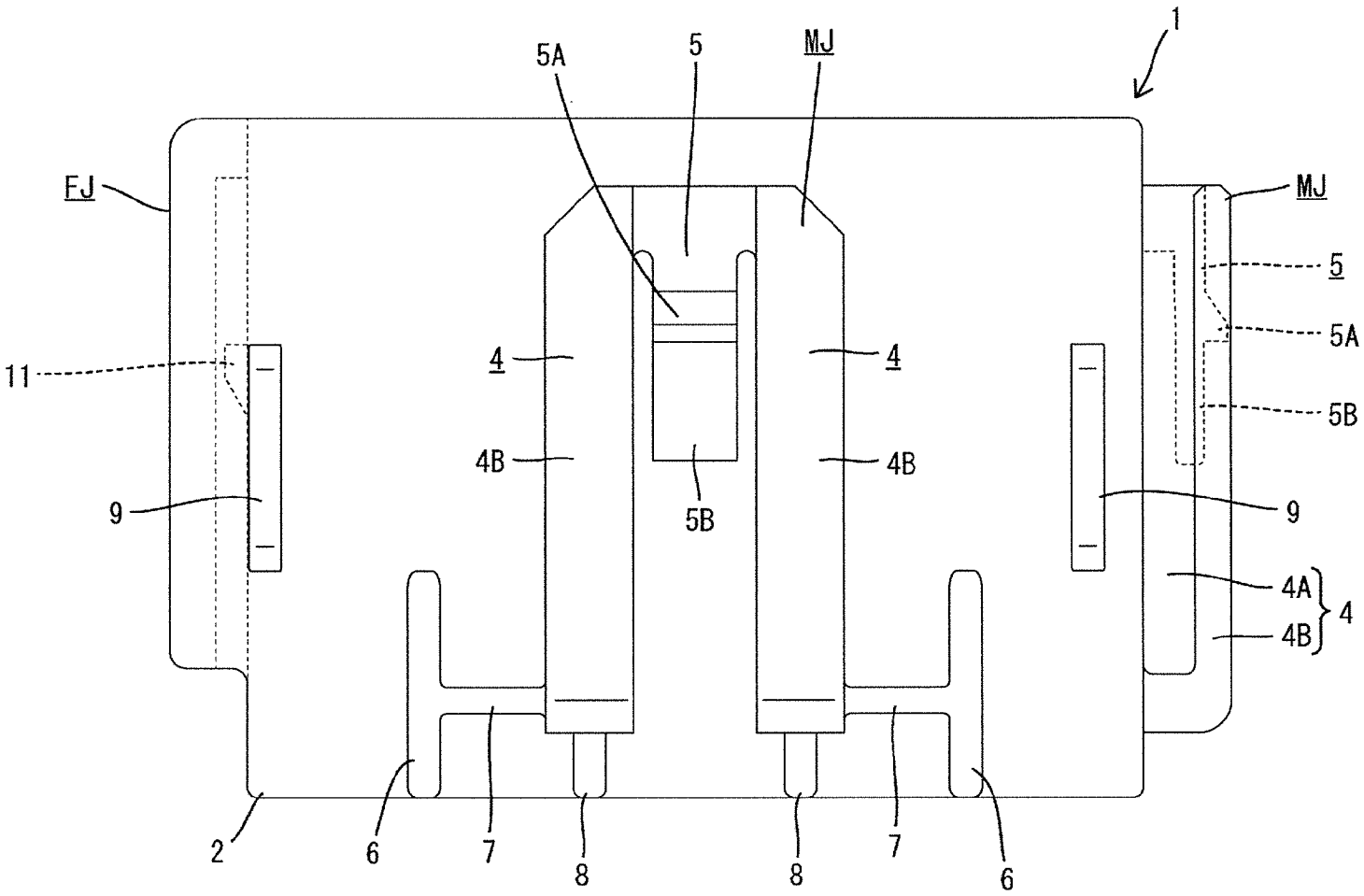
FIG. 2 is a plan view of the connector.

As shown in FIG. 2, the male coupling portion MJ is arranged in a lateral central part of the upper surface of the connector housing 1. The male coupling portion MJ includes a pair of coupling walls 4 extending along a connecting direction of male and female connectors. The coupling walls 4 extend in parallel along the connecting direction to positions slightly before the rear end of the connector housing 1 with positions slightly behind an opening surface of the receptacle 2 as starting ends. Each of the both coupling walls 4 is composed of a base portion 4A standing up from the upper surface of the connector housing 1 and a flange wall 4B protruding outwardly from a standing end part of the base portion 4A. Back end parts of the coupling walls 4 are coupled and a locking arm 5 is connected to this coupling part. The locking arm 5 is cantilevered toward a connection surface side substantially in parallel to the both coupling walls 4 and formed to be resiliently deformable. Further, a lock claw 5A is formed to project upward in a central part of the upper surface of the locking arm 5, and a tip part thereof extends to serve as a lock releasing portion 5B.

As shown in FIG. 2, two vertical projections 6 project at positions of the upper surface of the connector housing 1 near the connection surface at opposite sides of the coupling walls 4 in a lateral direction. The vertical projections 6 extend along the connecting direction and horizontal projections 7 protrude inwardly from intermediate positions of the vertical projections 6 and are connected to the coupling walls 4. Note that, in this embodiment, two center projections 8 project to extend from the opening edge of the connection surface to the front ends of the coupling walls 4. An opening edge part of the receptacle 2 is reinforced by these projections 6 to 8 to enhance the coupling strength of the connector housings 1.

Further, as shown in FIG. 2, two upper-surface side ribs 9 (holding portions) are formed to project near opposite widthwise end parts of the upper surface of the connector housing 1 and in a central part in the connecting direction. The upper-surface side ribs 9 extend along the connecting direction and are provided over a predetermined length range. The upper-surface side ribs 9 are formed to be slightly higher than the respective projections described above, but have a smaller projecting height than the both coupling walls 4. Further, the upper surfaces of the upper-surface side ribs 9 are flat surfaces.

Figure 3:
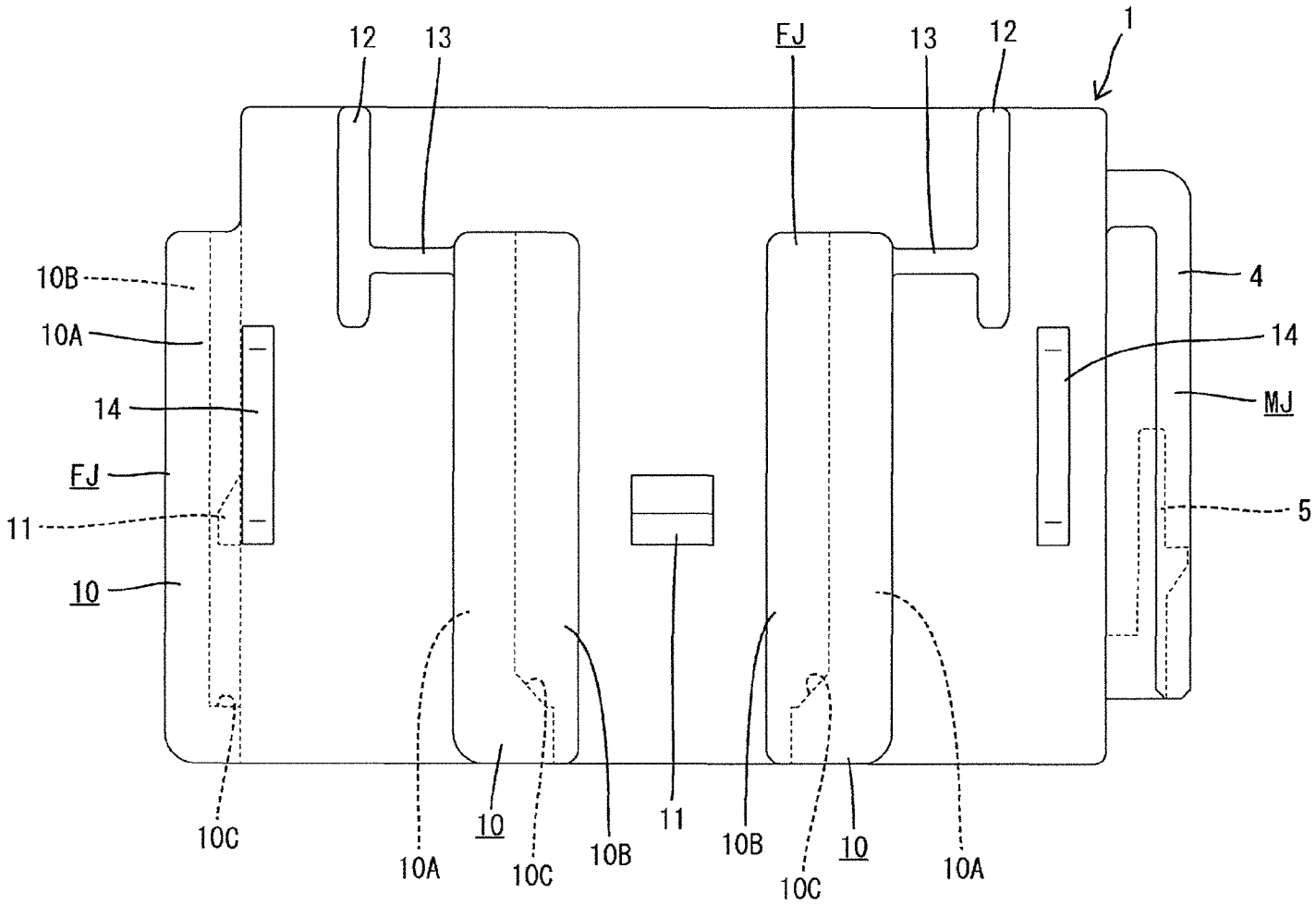
FIG. 3 is a bottom view of the connector.

As shown in FIG. 3, the female coupling portion FJ is arranged in a lateral central part of the lower surface of the connector housing 1. The female coupling portion FJ includes a pair of guiding walls 10 extending along the connecting direction of the connector. The guiding walls 10 are formed with a length to reach a back end part of the connector housing 1 with positions slightly behind the connection surface of the connector housing 1 as starting ends. Further, each of the guiding walls 10 is composed of a side wall 10A projecting from the lower surface of the connector housing 1 and a ceiling all 10B protruding inwardly from the projecting end of this side wall 10A and formed to have a substantially inverted L-shaped cross-section. A distance between the guiding walls 10 is set so that the coupling walls 4 of the male coupling portion MJ formed on the upper surface of the connector housing 1 can fit between the guiding walls 10. Further, the guiding walls 10 are formed to be open toward the connection surface side, but stopper walls 10C protrude inwardly at back end parts. These stopper walls 10C can come into contact with the back end parts of the coupling walls 4 of the male coupling portion MJ when the female and male coupling portions FJ, MJ are coupled. Further, a locking protrusion 11 is formed to project in a central part in the connecting direction and the lateral direction between the guiding walls 10. This locking protrusion 11 is locked to the locking arm 5 to prevent the connector housings 1 from being separated when the female and male coupling portions FJ, MJ are coupled.

Further, the vertical projections 12 project at laterally outer positions of the guiding walls 10 near the connection surface on the lower surface of the connector housing 1. Horizontal projections 13 protrude inwardly from intermediate positions of the vertical projections 12 and are connected to the side walls 10A of the guiding walls 10. The opening edge part of the receptacle 2 is reinforced by these projections 12, 13 to enhance the coupling strength of the connector housings 1 in cooperation with the respective projections 6 to 8 on the upper surface side.

Note that a distance between the vertical projections 12 formed on the lower surface side of the connector housing 1 is set to be larger than that the distance between the projections 6 formed on the upper surface side.

Further, two lower-surface side ribs 14 (holding portions) project near opposite widthwise end parts of the lower surface of the connector housing 1 and in a central part in the connecting direction. The lower-surface side ribs 14 extend along the connecting direction and are provided over a predetermined length range. The lower-surface side ribs 14 are slightly higher than the respective projections 12, 13 described above, but have a smaller projecting height than the guiding walls 10. Further, the lower surfaces of the lower-surface side ribs 14 are flat surfaces. The lower-surface side ribs 14 are formed with substantially the same projecting height as the upper-surface side ribs 9 and arranged at positions vertically corresponding to the upper-surface side ribs 9. As shown in FIG. 6, with the both connector housings 1 coupled, the vertically corresponding upper-surface side ribs 9 and lower-surface side ribs 14 butt against each other over the entire lengths.

Note that when the upper-surface side ribs 9 and the lower-surface side ribs 14 butt against each other as just described, a force acts to press the upper surfaces of the coupling walls 4 against the inner walls of the ceiling walls 10B of the guiding walls 10.

Figure 4:
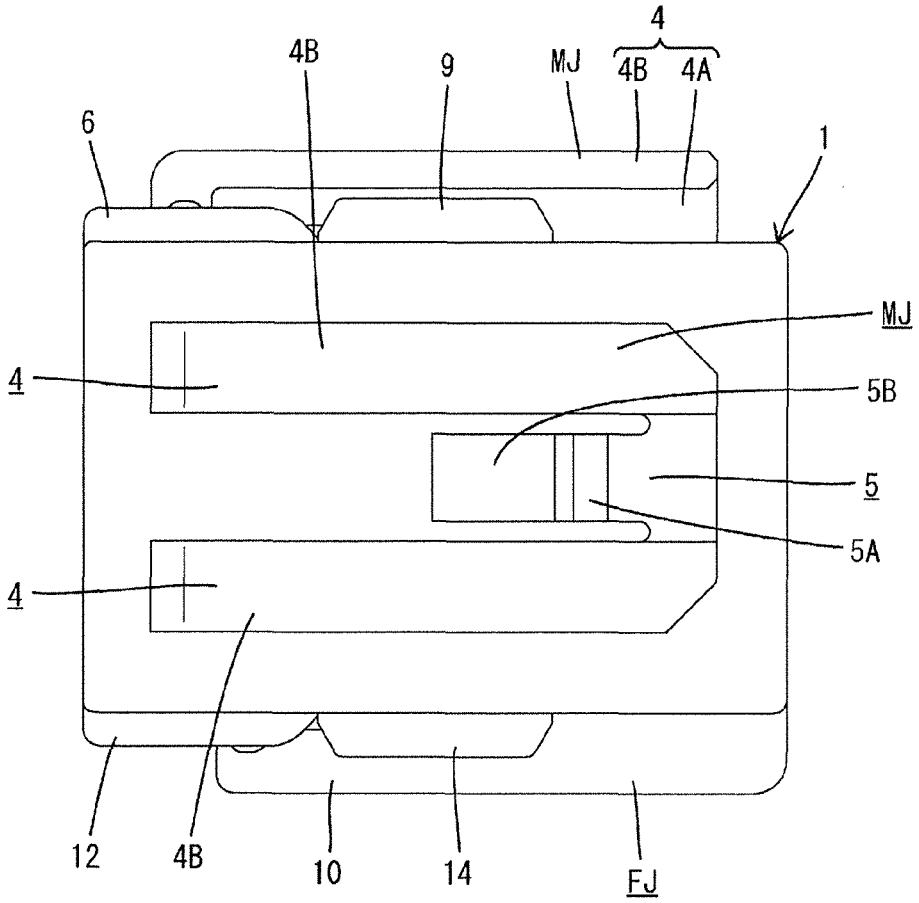
FIG. 4 is a right side view of the connector.

As shown in FIG. 4, the male coupling portion MJ is arranged on the right side surface of the connector housing 1. This male coupling portion MJ has the same configuration as that provided on the upper surface of the connector housing 1, and hence is not described.

Figure 5:
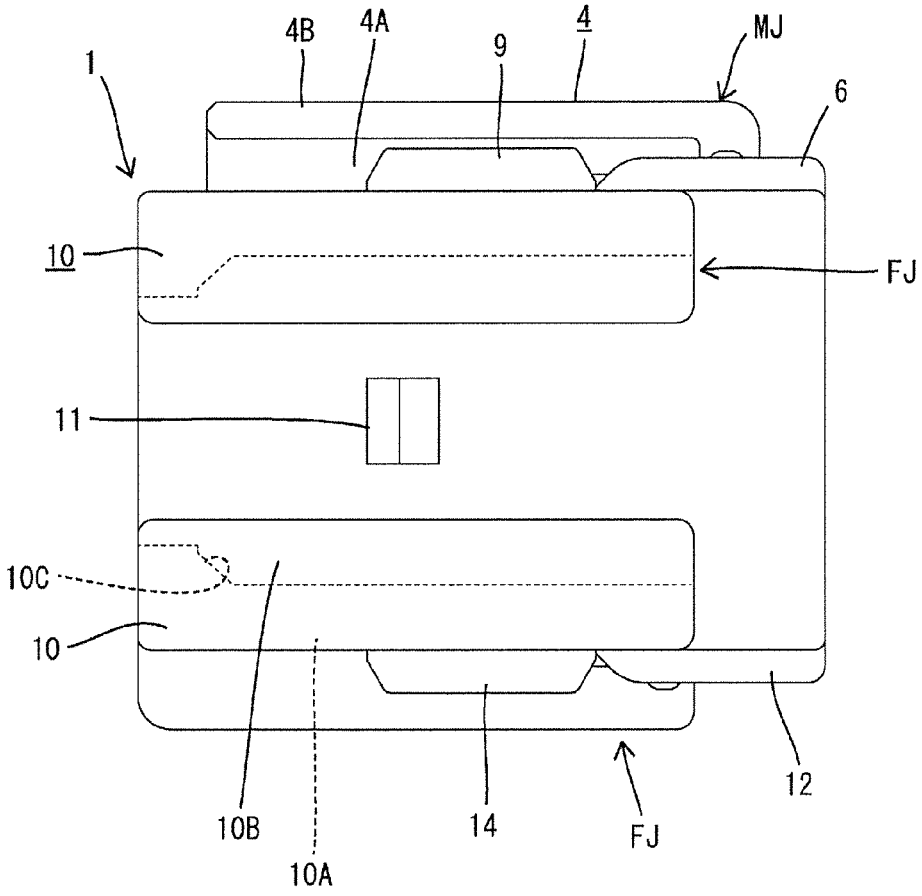
FIG. 5 is a left side view of the connector.

On the other hand, as shown in FIG. 5, the female coupling portion FJ is arranged on the left side surface of the connector housing 1. This female coupling portion FJ has the same configuration as that provided on the lower surface of the connector housing 1 and hence is not described. However, the female coupling portion FJ provided on the left side surface of the connector housing 1 is provided substantially over the entire width range of this surface.

Figure 7:
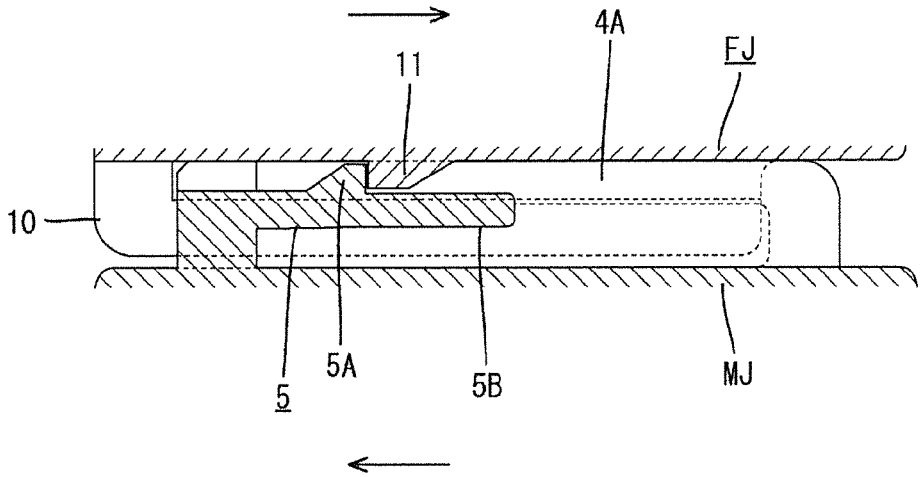
FIG. 7 is a section enlargedly showing a lock structure of coupling portions.

Next, a case where the connectors configured as described above are coupled is described. In the case of vertically coupling the connectors, two connectors to be coupled are located one above the other while being shifted in the connecting direction, and a rear end part of the male coupling portion MJ provided on the upper surface of one connector housing 1 is aligned with an opening side (connection surface side) of the female coupling portion FJ (both guiding walls 10) provided on the lower surface of the other connector housing 1. In this state, when the connectors are slid along the connecting direction (see FIG. 7), the coupling walls 4 are fit to the back parts of the guiding walls 10 while being guided by the guiding walls 10. When the female and male coupling portions FJ, MJ are fit to such a depth that the rear ends of the coupling walls 4 come into contact with the stopper walls 10C of the female coupling portion FJ, the locking arm 5 and the locking protrusion 11 are locked so that forward and backward movements of the upper and lower connector housings 1 along the connecting direction are restricted. As a result, the upper and lower connector housings 1 are coupled in an inseparable state.

While the female and male coupling portions FJ, Mf are being fit together, the upper-surface side ribs 9 and the lower-surface side ribs 14 located at the corresponding positions slide in contact with each other. Thus, the upper and lower connector housings 1 are not inclined in the lateral direction during this time and the fitting operation can be performed smoothly. Even if a pressing force acts on either one of the connector housings 1 in an oblique direction with the upper and lower connector housings 1 coupled, the inclination of the upper and lower connector housings 1 is avoided by the contact of the upper-surface side ribs 9 and the lower-surface side ribs 14. Thus, the coupled state of the upper and lower connector housings 1 can be stabilized.

Further, the upper-surface side ribs 9 and the lower-surface side ribs 14 are formed to have a smaller height than the female and male coupling portions FJ, MJ. Thus, an effect of protecting the upper-surface side ribs 9 and the lower-surface side ribs 14 from contact with external matters is obtained by the coupling portions FJ, MJ.

Figure 8:
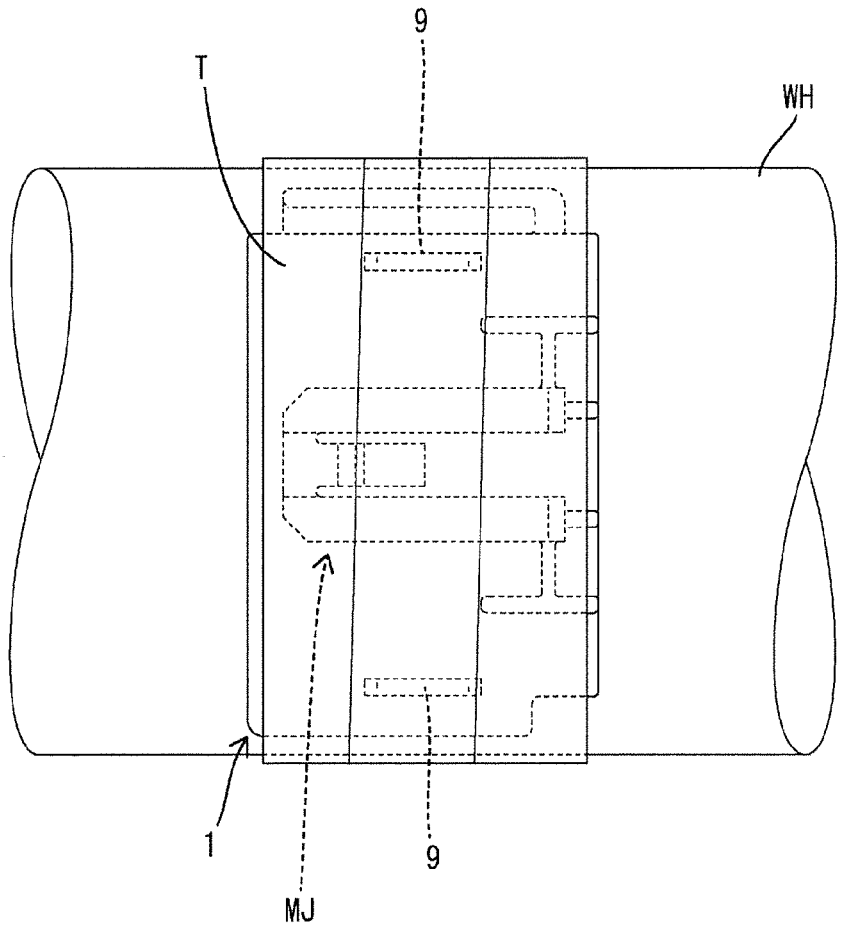
FIG. 8 is a plan view showing a state where the connector is fixed to a wiring harness by winding a tape.
Figure 9:
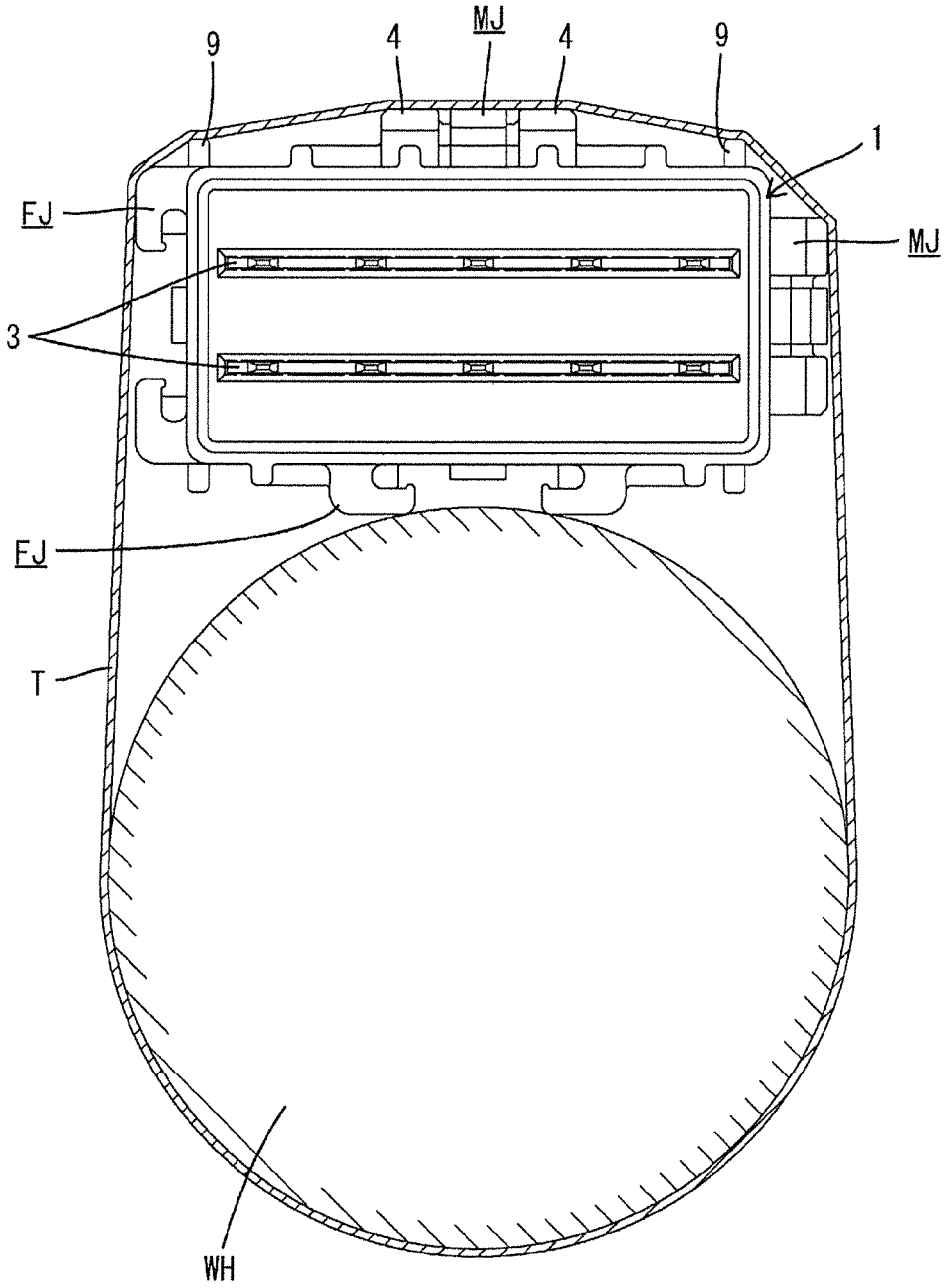
FIG. 9 is a front view showing the state of FIG. 8.

The above-described connector may be used by being connected to wires branched off from a wiring harness WH and fixed to the wiring harness WH by taping as shown in FIGS. 8 and 9.

In the case of taping around the connector, a tape T is wound in a direction substantially perpendicular to the connecting direction of the connector. Further, a winding width of the tape T is at least larger than lengths of the upper-surface side ribs 9 and the lower-surface side ribs 14 in an extending direction and, in this embodiment, in a range extending substantially over the entire length of the connector housing 1 in the connecting direction. The tape T is wound around the connector and the wiring harness WH in a tense state. As a result, in a side view shown in FIG. 9, the tape T is pushed slightly up at the both upper-surface side ribs 9 between the male coupling portion MJ and the opposite left and right side surfaces of the connector housing 1. Thus, in a plan view shown in FIG. 8, the tape T is inclined downward at front or rear sides of opposite extending end parts of the both upper-surface side ribs 9. That is, the tape T is caught in a front-back direction (connecting direction) at the opposite extending end parts of the upper-surface side ribs 9. Thus, the wound tape T is prevented from being displaced forward or backward along the connecting direction by being caught in this way. As a result, the connector can be reliably fixed to the wiring harness WH.

Further, as described above, the upper-surface side ribs 9 are formed to be lower than the male coupling portion MJ. If the upper-surface side ribs 9 are formed to be higher than the male coupling portion MJ, the tape T is lifted above the male coupling portion MJ in the case of being wound and a connector holding force is reduced. However, according to this embodiment, the tape T can be held reliably in close contact with the male coupling portion MJ and the both upper-surface side ribs 9. In addition, in this embodiment, the ribs 9, 14 are formed on the both upper and lower surfaces of the connector housing 1 and the both ribs 9, 14 butt against each other when the connectors are coupled. Thus, in the case of singly fixing the connector to the wiring harness WH without being coupled to another connector as shown in FIG. 8, a catching function by the ribs 9, 14 is exhibited and the taped state can be stabilized regardless of which of the upper and lower surfaces of the connector housing 1 is brought into contact with the wiring harness WH.

The present invention is not limited to the above described and illustrated embodiment. For example, the following embodiments are also included in the technical scope of the present invention.

Although the ribs 9, 14 project on the both upper and lower surfaces of the connector housing 1 in the above embodiment, the ribs may be provided only on one surface.

Although the joint connector mounted with the joint terminals 3 is illustrated in the above embodiment, the type of the connector does not matter. The present invention is applicable to connectors mounted with ordinary terminals.

Although two ribs 9, 14 are provided on each of the upper and lower surfaces of the connector housing 1 in the above embodiment, a plurality of pairs of ribs may be provided. Further, a plurality of ribs 9, 14 may be formed while being separated along the connecting direction.

LIST OF REFERENCE SIGNS

1 . . . connector housing
9 . . . upper-surface side rib (holding portion)
14 . . . lower-surface side rib (holding portion)
FJ . . . female coupling portion
MJ . . . male coupling portion
WH . . . wiring harness
T . . . tape

The invention claimed is:

1. A connector, comprising:

a connector housing couplable to a plurality of connector housings;

a coupling portion provided on an outer surface of the connector housing and enabling the connector housings to be coupled to each other; and holding portions projecting at opposite sides of the coupling portion on the outer surface of the connector housing and capable of butting against the connector housing as a coupling partner when the connector housings are coupled, the holding portions projecting on both facing surfaces when the both connector housings are coupled and projecting heights thereof being lower than that of the coupling portion.

2. A structure for fixing the connector of claim 1 to a wiring harness by winding a tape, wherein:

the holding portions are ribs extending in a direction substantially perpendicular to a winding direction of the tape and projecting from the outer surface of the connector housing; and the connector is so taped to the wiring harness that a winding width of the tape is larger than lengths of the ribs in an extending direction and extending end parts of the ribs serve as parts for catching the tape in the extending direction.

* * * * *